US008182360B2

(12) United States Patent
Cameron

(10) Patent No.: US 8,182,360 B2
(45) Date of Patent: May 22, 2012

(54) GOLF CLUB WITH A RIGID SHAFT BAND

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 227 days.

(21) Appl. No.: 12/694,546

(22) Filed: Jan. 27, 2010

(65) Prior Publication Data

US 2011/0183773 A1 Jul. 28, 2011

(51) Int. Cl.
*A63B 53/10* (2006.01)
*A63B 53/12* (2006.01)

(52) U.S. Cl. ..... 473/297; 473/318

(58) Field of Classification Search ..... 473/316–323, 473/297

See application file for complete search history.

(56) References Cited

U.S. PATENT DOCUMENTS

| | | | | | |
|---|---|---|---|---|---|
| 5,234,217 | A | | 8/1993 | Johnson | |
| 5,248,141 | A | | 9/1993 | Kelly | |
| 5,277,423 | A | * | 1/1994 | Artus | 473/319 |
| 5,294,119 | A | * | 3/1994 | Vincent et al. | 473/318 |
| 5,297,791 | A | * | 3/1994 | Negishi | 473/321 |
| 5,460,378 | A | * | 10/1995 | Getts | 473/251 |
| 5,467,984 | A | * | 11/1995 | Veux et al. | 473/291 |
| 5,569,097 | A | * | 10/1996 | Veux et al. | 473/292 |
| 5,735,752 | A | | 4/1998 | Antonious | |
| 5,755,826 | A | * | 5/1998 | Beach et al. | 473/316 |
| 5,800,285 | A | | 9/1998 | Thorne et al. | |
| 5,931,744 | A | | 8/1999 | Hackman | |
| 5,943,758 | A | * | 8/1999 | Haas | 29/516 |
| 6,007,431 | A | | 12/1999 | Bloom, Jr. | |
| 6,431,996 | B1 | * | 8/2002 | Wright et al. | 473/318 |
| 6,447,401 | B1 | | 9/2002 | Torkos | |
| 6,679,787 | B2 | | 1/2004 | Unosawa | |
| 7,338,390 | B2 | | 3/2008 | Lindsay | |
| 7,377,859 | B2 | | 5/2008 | Reardon | |
| 7,967,696 | B2 | * | 6/2011 | Takeuchi | 473/318 |
| 2007/0072693 | A1 | | 3/2007 | Kallberg | |
| 2010/0292022 | A1 | * | 11/2010 | Stites | 473/318 |

FOREIGN PATENT DOCUMENTS

| | | | |
|---|---|---|---|
| JP | 10192465 A | * | 7/1998 |
| JP | 11076470 A | * | 3/1999 |
| JP | 11104284 A | * | 4/1999 |
| JP | 2001246028 | * | 9/2001 |
| JP | 2001246028 A | * | 9/2001 |

* cited by examiner

*Primary Examiner* — Stephen L. Blau
(74) *Attorney, Agent, or Firm* — Randy K. Chang

(57) ABSTRACT

A golf club with a rigid shaft band is disclosed herein. More specifically, the present invention discloses a golf club with a rigid shaft band that is placed at a precise location on the shaft itself, utilizing a precise taper within the internal surface of the rigid shaft band to control the location. Even more specifically, the rigid shaft band may be placed at a distance that is greater than about 1 inch and less than about 3 inches away from the butt end of the golf club with a tapered internal surface of greater than about 0.573 degrees and less than about 1.146 degrees.

16 Claims, 8 Drawing Sheets

GOLF CLUB WITH A RIGID SHAFT BAND

FIELD OF THE INVENTION

The present invention relates a golf club with a head, a shaft, a grip, and a rigid shaft band attached to the shaft of the golf club. More specifically, the rigid shaft band in accordance with the present invention may contain one or more markings, and is fixedly attached to the shaft of a golf club at a preferred location. Even more specifically, the rigid shaft band in accordance with the present invention may contain a tapered inner surface that coincides with the tapered outer surface of the golf club shaft, controlling the location of the rigid shaft band along the length of the golf club shaft to improve the cosmetic appeal and the performance of the golf club itself.

BACKGROUND OF THE INVENTION

Golf clubs have generally been designed with three major components, a head, a shaft, and a grip. Although there are instances where other minor components such as the ferrule may be added to the golf club to improve the cosmetic transition between the head and the shaft, the three major components mentioned above are the most visible elements of a golf club itself.

Because of the need for different manufacturers to promote their product, the various manufacturers will generally try to promote their own product by putting their names on the golf club itself. However, due to the limited space available on a golf club for the placement of such an advertisement, and because of the need for enhanced cosmetic appeal, the various manufacturers have to utilize creative methods to promote their product beyond merely slapping a sticker onto the product itself. More often than not, the various advertising efforts of the manufacturer will seamlessly incorporate their company logo together with the golf club itself in a way that enhances the cosmetic appeal of a golf club.

U.S. Patent Publication No. 2007/0072693 by Kallberg illustrates one of these attempts to seamlessly decorate the head of a golf club by disclosing a method that selects a visual display, presents a desired message, and couples the visual display to a top surface of a golf club head. U.S. Pat. No. 7,377,859 to Reardon illustrates an attempt to create a decorative grip of a golf club by disclosing a decorative grip system that includes a decorative grip having a label with decorative indicia located thereon, including an underlay layer located generally inside of the label and a generally translucent overlay layer located outside of the label. Finally, U.S. Pat. No. 6,679,787 to Unosawa illustrates an attempt to decorate the shaft of a golf club by disclosing an upper ply being transparent or at least having translucency to the extent that the interior surface is visible, and a lower ply having different surface configuration from the upper ply, and the surface configuration of which can be seen through the upper ply provided underneath the upper ply.

Golf club shafts, due to their relatively large surface area, combined with the relatively manageable geometry, are often the prime location for incorporating the decorative marks of a manufacturer. U.S. Pat. No. 5,234,217 to Johnson illustrates one of the more common ways of decorating the shaft of a golf club head by either printed on the surface of the shaft or can be in the form of an elongated sticker that is wrapped around the shaft. Utilizing a sticker type decorative band around the shaft of a golf club, although greatly enhances the visibility and cosmetic appeal of a golf club shaft, may be undesirable because the stickers can come apart from the golf club shaft itself. These stickers, although originally intended to enhance the cosmetic appeal of the golf club, begin losing their cosmetic appeal when they start peeling and cracking overtime.

In addition to enhancing the cosmetic appeal of a golf club, and due to the limited space and opportunity within the golf club itself for plain cosmetic enhancement, the cosmetic features that are used to improve the visual appeal of a golf club may often need to function to improve the performance of the golf club as well. U.S. Pat. No. 5,800,285 to Thorne et al. discloses a head of a golf club that has a decorative feature that also have a function component by having scorelines and circles that are depressions in the club face that function to decorate the head, assist in club-and-ball alignment, and to engage the golf ball surface to create golf ball spin. U.S. Pat. No. 5,248,141 to Kelly discloses a grip of a golf club that has a decorative feature that is also functional by having a groove pattern that, in addition to being decorative, acts much like the tread patterns of automobile tires, thus increasing the traction between the grip and a golfer's hands.

Hence, as it can be seen from above, attempts to improve the cosmetic appeal of the shaft of a golf club may be significantly flawed in numerous aspects. First and foremost, one of the most common ways of improving the cosmetic appeal of a shaft by utilizing stickers can end up cracking and peeling, causing them to detract from the cosmetic appeal of the golf club. Additionally, despite all the attempts above to incorporate cosmetic features that also improve the functionality to other components of the golf club such as the head and the grip, no relevant attempts have been made to do so with the cosmetic improvements directed at golf club shafts. Ultimately, because of the lack of development, there is a need in the field for a golf club that contains a feature that can improve the cosmetic appeal as well and the functional performance of a golf club shaft.

BRIEF SUMMARY OF THE INVENTION

One aspect of the present invention is a golf club comprising a grip at a proximal end of the golf club, a head at a distal end of the golf club, and a shaft connecting the grip and the head. The golf club in accordance with this aspect of the present invention may also comprise of a rigid shaft band that circumferentially encompasses the shaft. The rigid shaft band is further comprising an external surface, an internal surface, a top lip, and a bottom lip, wherein the location of the rigid shaft band along the shaft is determined by a first distance calculated by the distance between the top lip of the rigid shaft band and the grip. Finally, the golf club head in accordance with this aspect of the present invention may have greater than 90% of the internal surface of the rigid shaft band engaging the external surface of the shaft.

In another aspect of the present invention is a golf club comprising a grip at a proximal end of the golf club, a head at a distal end of the golf club, and a shaft connecting the grip and the head. The golf club in accordance with this aspect of the present invention may also comprise a rigid shaft band that circumferentially encompasses the shaft. The rigid shaft band is further comprising of an external surface, an internal surface, a top lip, and a bottom lip, wherein the location of the rigid shaft band along the shaft is substantially near a fulcrum of the golf club. Finally, the golf club head in accordance with this aspect of the present invention may have greater than 90% of the internal surface of the rigid shaft band engaging the external surface of the shaft.

In a further aspect of the present invention is a rigid shaft band comprising an external surface, an internal surface, a top lip, and a bottom lip, wherein the internal surface of the rigid shaft band is tapered at an angle of greater than about 0.573 degrees and less than about 1.146 degrees.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
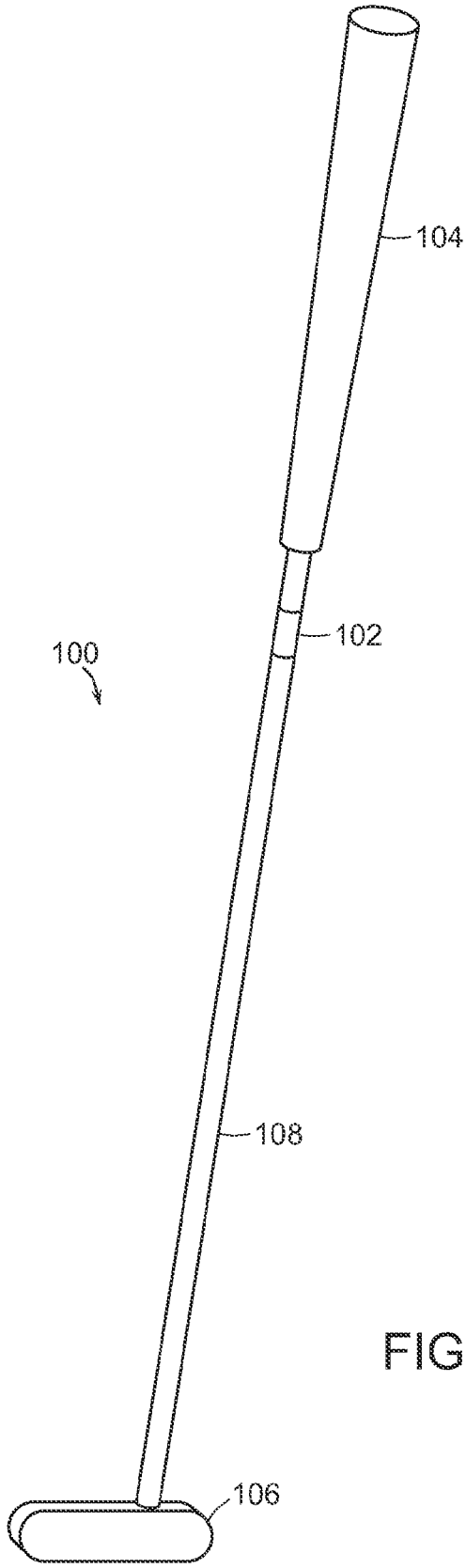
FIG. 1 shows a perspective view of a golf club in accordance with an exemplary embodiment of the present invention.

FIG. 1 here shows a perspective view of a golf club 100 containing a rigid shaft band 102 in accordance with an exemplary embodiment of the present invention. More specifically, golf club 100, as shown in the current exemplary embodiment, may have a grip 104 connected to a proximal end of the golf club 100 and a head 106 connected to a distal end of the golf club 100. The shaft 108, in this current exemplary embodiment, may generally be juxtaposed in between the grip 104 and the head 106, connecting the grip 104 to the head 106.

It should be noted here that the rigid shaft band 102 shown in FIG. 1 may generally be used to improve the cosmetic appeal of the golf club 100 as well as improve the performance of the golf club 100. Cosmetically, when compared to a prior art shaft sticker, the current rigid shaft band 102 provides a more sturdy look that is more desirable than the flimsy sticker used on the prior art golf club shafts. Performance wise, the rigid shaft band 102 not only provides a more permanent way of enhancing the look and feel of the golf club 100, it could also help by absorbing the unnecessary vibrations, adjusting the weight and/or swingweight of the golf club, or even assisting with the alignment of the golf club 100 itself.

In order to completely understand the severity of the drawback of a prior art shaft sticker, it may be necessary to first understand how a golfer stores and carries his or her golf clubs. Because a golfer requires numerous golf clubs during a round of golf, golfers generally utilize a golf bag with openings near the top of the golf bag, where the golf clubs are inserted. More often than not, and in order to maintain the relative position of the golf clubs within the golf bag, these golf bags come equipped with dividers at the opening of the golf bag. Hence, a golfer, as he or she is playing a round of golf, may take out his or her clubs and put them back into his bag many times, subjecting the prior art shaft sticker to numerous abrasions with the opening of the bag as well as the dividers of the bag. Hence, as any golfer can tell you, these prior art shaft stickers begin to peel and crack due to the normal wear and tear of playing golf, making them visually unsightly.

The rigid shaft band 102, as shown in FIG. 1, helps address this common issue associated with the deterioration, peeling, and cracking of these prior art shaft stickers by providing an alternative that is less flimsy and more durable. In addition to eliminating all of the drawbacks of the prior art shaft stickers, the rigid shaft band 102 may also provide numerous performance features such as the ability to absorb the vibration of the shaft 108, the ability to adjust the overall weight of the golf club 100 without adjusting the swingweight, the ability to make minor and precise adjustment to the swingweight of the golf club, the ability to help with the alignment of the grip 104, and numerous other performance benefits achievable by having such a rigid shaft band 102.

Figure 2:
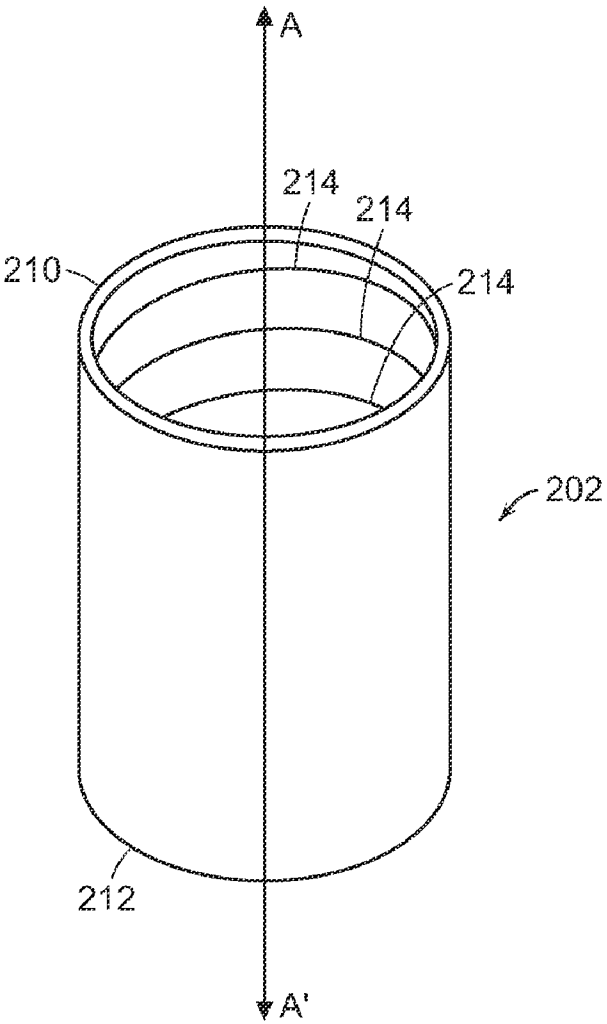
FIG. 2 shows a perspective view of a rigid shaft band in accordance with an exemplary embodiment of the present invention.

FIG. 2 shows an enlarged perspective view of the rigid shaft band 202 in accordance with an exemplary embodiment of the present invention. This enlarged perspective view of the rigid shaft band 202 allows a clearer view of the top lip 210, the bottom lip 212, as well as the depressions 214 within the internal surfaces of the rigid shaft band 202. The top lip 210 of the rigid shaft band 202, as shown in the current exemplary embodiment, may generally be located near the top of the golf club 100 (shown in FIG. 1) closer to the grip 104 (shown in FIG. 1) portion of the golf club 100. The bottom lip 212, alternatively, may be placed further away from the grip 104 (shown in FIG. 1) and closer to the head 106 (shown in FIG. 1) of the golf club 100 (shown in FIG. 1). The orientation of the rigid shaft band 202 may be important to the proper functionality of the rigid shaft band 202 itself, as the internal surface of the rigid shaft band 202 may have a taper that would prohibit the rigid shaft band 202 to be assembled in the reverse direction. Finally the plurality of depressions 214 shown in FIG. 2 are important to the operation of the rigid shaft band 202, as they may generally serve to retain a bonding material that securely connects the rigid shaft band 202 to the shaft 108 (shown in FIG. 1) itself.

It is worth noting here that although the current exemplary embodiment utilizes an adhesive as the bonding material to fill the depression 214 of the rigid shaft band 202, alternative materials may be used to fill the depression 214 to achieve that same goal without departing from the scope and content of the present invention. For example, the bonding material may be a vibration dampening material that is capable of holding the rigid shaft band 202 in place while absorbing the vibrations of the shaft 108 (shown in FIG. 1) without departing from the scope and content of the present invention. More specifically, the vibration dampening material may be a polymer type material, an elastomer type material, a rubber type material, plastic type material, or any other material capable of providing vibration dampening all without departing from the scope and content of the present invention. Ultimately, the depression 214 may be filled with any material capable of holding the rigid shaft band 202 on to the shaft 108 (shown in FIG. 1) with or without vibration dampening characteristics, all without departing from the scope and content of the present invention.

The depressions 214 within the internal surface of the rigid shaft band 202, as shown in this current exemplary embodiment in FIG. 2, may take on many shapes. In one embodiment of the present invention the depressions 214 can be comprised of multiple circular ring shaped depressions 214 covering the internal surface of the rigid shaft band 202. In an alternative embodiment of the present invention, the rigid shaft band 202 be one continuous depression 214 within the internal surface of the rigid shaft band 202 resembling the shape of a spiral rotationally traversing the internal surface of the rigid shaft band 202. It should be noted that although two of the more common shapes used for the depression 214 are disclosed above, numerous other shapes and geometries can be used to form the depression 214 within the internal wall of the rigid shaft band without departing from the scope and content of the present invention; so long as it is capable of providing an place for the bonding material.

The rigid shaft band 202, as disclosed within this current exemplary embodiment of the present invention, may generally be manufactured out of a metallic material to enhance the durability of the rigid shaft band 202; especially when compared to the tacky shaft sticker used by the prior art golf clubs. More specifically, the rigid shaft band 202 may be manufactured out of aluminum for its light weight properties, stainless steel for its cosmetic appeal, titanium for its strength properties, or even tungsten for its high density properties. However, rigid shaft band 202 may be manufactured out of various other materials such as plastic, carbon fiber, rubber, or any other material capable of retaining its rigid shape and size along the shaft 108 (shown in FIG. 1) all without departing from the scope and content of the present invention.

Figure 3:
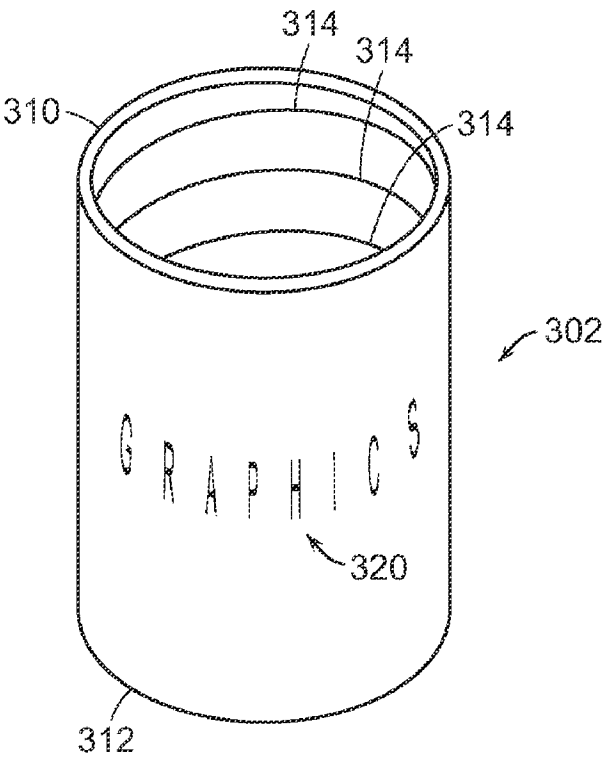
FIG. 3 shows a perspective view of a rigid shaft band in accordance with an alternative embodiment of the present invention.

FIG. 3 shows a perspective view of a rigid shaft band 302 in accordance with further alternative embodiment of the present invention wherein the external surface may contain graphics 320 to further enhance the cosmetic appeal of the rigid shaft band 302. The graphics 320, as shown in the current exemplary embodiment, may generally contain a company's logo or slogan to help advertise and promote the company's product. However, numerous other graphics 320 could be used to convey any type of message without departing from the scope and content of the present invention. For example, in an alternative embodiment of the present invention, the graphics 320 could contain valuable information about the specification of the golf club such as the loft of the golf club, the lie of the golf club, the length of the golf club, the swingweight of the golf club, the flex of the golf club, or even customized ownership information all without departing from the scope and content of the present invention. In fact, the term graphics 320 used in FIG. 3 is not limited to the specific characters of g, r, a, p, h, i, c, and s, but relate generally to any sort of visual illustrations. More specifically, graphics, as referred to in the current exemplary embodiment could refer to a company log, a company name, a product log, a product name, a graphical display, an alignment arrow, an alignment log, an alignment dot, an alignment line, any type of numbers, characters, or any visual illustration capable of conveying a visual stimulant all without departing from the scope and content of the present invention.

The graphics 320 shown in FIG. 3 may generally be etched into the external surface of the rigid shaft band 302 to create a permanent imprint. Because of the rigidity of the rigid shaft band 302, etching the graphics 320 into the external surface may be the most logical methodology that preserves and enhanced cosmetic appearance of the rigid shaft band 302. Despite the preference for etching, numerous other marking techniques such as stamping, painting, airbrushing, or even using a sticker may be used to achieve similar results without departing from the scope and content of the present invention so long as it is capable of creating a visual graphics 320 around the rigid shaft band 302.

Figure 4:
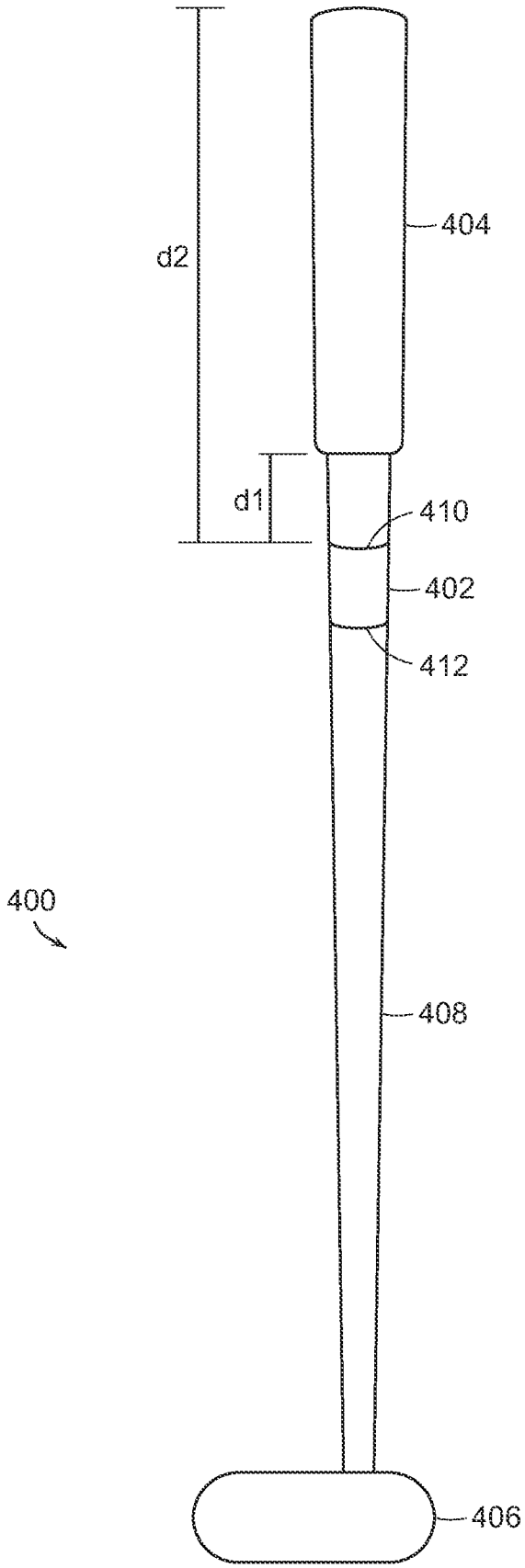
FIG. 4 shows a frontal view of a golf club in accordance with an alternative embodiment of the present invention wherein the shaft is tapered.

FIG. 4 shows a frontal view of a golf club 400 in accordance with an exemplary embodiment of the present invention allowing a better view of how the rigid shaft band 402 connects to a shaft 408 that is tapered. Because of the enlarged view of the shaft 408 of the golf club 400, we can see that in this exemplary embodiment of the present invention, the shaft 408 may have a smooth taper that decreases in diameter from the butt end of the shaft 408 to the tip end of the shaft 408. The butt end of the shaft 408, as shown in the current exemplary embodiment with a thicker diameter, may generally be connected to the grip 404; while the tip end of the shaft 408, with a thinner diameter, may generally be connected to the head 406. Because of this tapering of the shaft 408, the internal surface of the rigid shaft band 402 may need to be tapered to ensure a proper fit between the two components. More specifically, the amount of taper within the internal surface of the rigid shaft band 402 and the actual internal diameter of the rigid shaft band 402 may help determine the precise location of the rigid shaft band 402 along the shaft 408. Finally, due to the tapering of the shaft 408, it may generally be preferable to assemble the rigid shaft band 402 by sliding it onto the shaft 408 from the tip end, before the head 406 is installed.

FIG. 4, in addition to showing the tapering of the shaft 408, also shows the relative location and placement of the rigid shaft band 402 along the shaft 408 at a preferred location. More specifically, in one exemplary embodiment of the present invention, the rigid shaft band 402 is placed at a distance d1 away from the grip 404. Even more specifically, the top lip 410 of the rigid shaft band 402 may be a distance d1 away from the terminal end of the grip 404. Distance d1, as shown in the exemplary embodiment may generally be greater than about 1 inch and less than about 3 inches to maximize the visual exposure of the rigid shaft band 402 from an address angle; however, d1 may more preferably be about 2 inches yielding an ideal location that enhances the cosmetic appeal of the golf club 400 itself.

In an alternative embodiment of the present invention, the location of the rigid shaft band 402 along the shaft 408 at a preferred location could be calculated to be a distance d2 away from the butt end of the grip 404. More specifically, the top lip 410 of the rigid shaft band 402 may be at a distance d2 away from the butt end of the grip 404. This distance d2, as shown in the current exemplary embodiment, may generally be about 14 inches, signifying the location of the fulcrum of the golf club 400. The fulcrum, as it is commonly known in the industry, refers to a balance point of the golf club 400 wherein a swingweight of the golf club 400 could be determined by the difference in weight on either side of the fulcrum. Having the rigid shaft band 402 placed at or near the fulcrum of the golf club 400 may provide an additional performance benefit that was previously not achievable by the prior art shaft stickers. More specifically, because the rigid shaft band 402 contains significantly more weight than the prior art shaft stickers, placing the rigid shaft band 402 around the fulcrum of the golf club 400 will allow an adjustment to be made to the total weight of the golf club 400 without affecting the swingweight of the golf club 400. Alternatively, by adjusting the exact location of the rigid shaft band 402 near the fulcrum of the golf club 400, combined with the additional weight of the rigid shaft band 402, the swingweight of the golf club 400 itself may be changed in microscopic increments without departing from the scope and content of the present invention. This microscopic adjustment in the swingweight of the golf club 400 may be desirable for fitting situations where such precision is required, as such precise adjustments are not possible at either the tip end or the butt end of the golf club 400.

Figure 5:
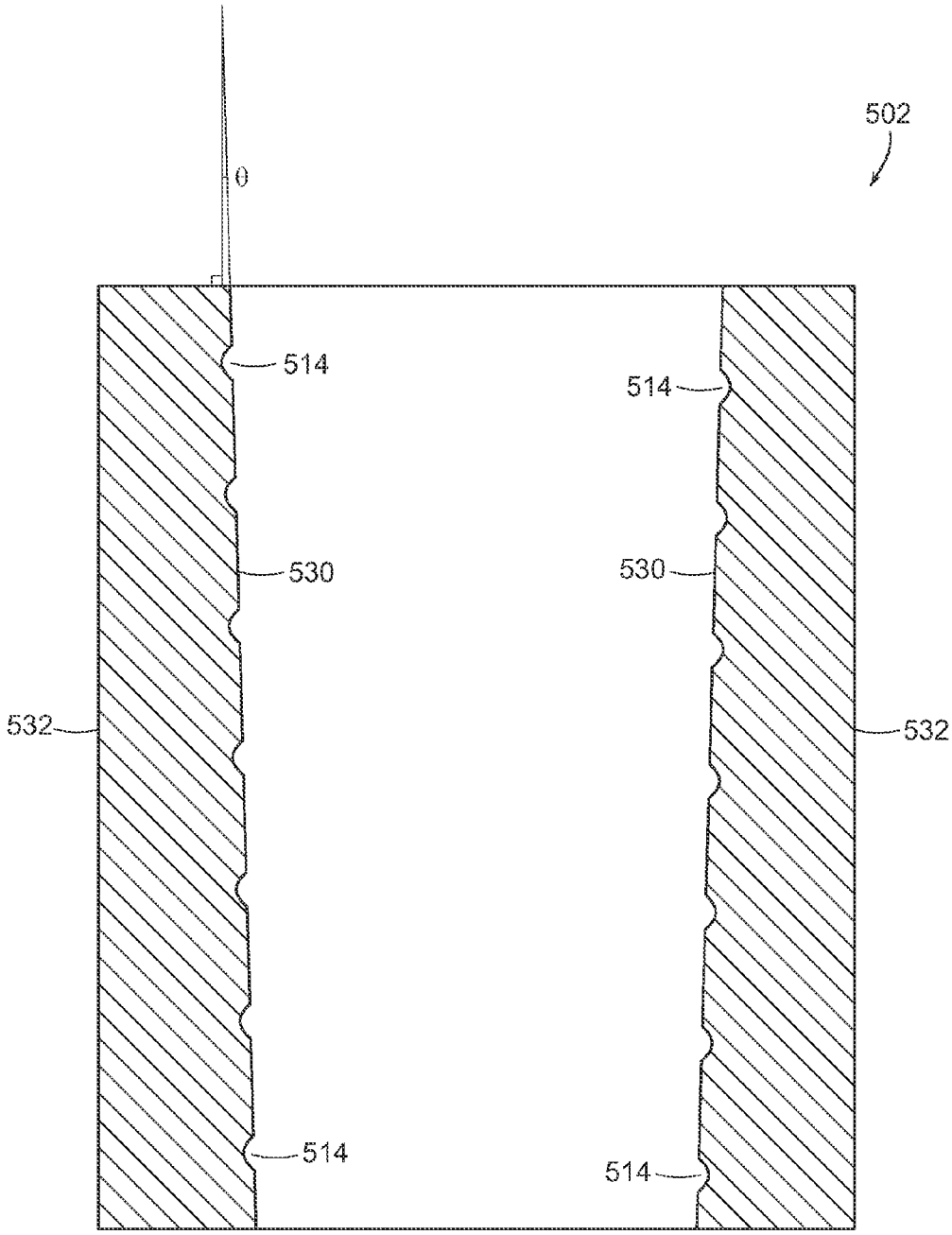
FIG. 5 shows a cross-sectional view of a rigid shaft band in accordance with an alternative embodiment of the present invention taken along cross sectional line A-A' in FIG. 2.

FIG. 5 shows a cross-sectional view of a rigid shaft band 502 in accordance with an exemplary embodiment of the present invention taken along cross-sectional line A-A' shown in FIG. 2. The cross-sectional view of the rigid shaft band 502, as shown in FIG. 5, more clearly shows the tapering of the internal surface 530 of the rigid shaft band 502 in order to match the tapering of the shaft 408 (shown in FIG. 4). It is worth noting here that the amount of tapering may generally be greater than about 0.01 inches per inch and less than about 0.02 inches per inch, more preferably greater than about 0.013 inches per inch and less than about 0.0196 inches per inch, and most preferably about 0.0147 inches per inch. Alternatively speaking, the angle θ of the tapering may generally be greater than about 0.574 degrees and less than about 1.146 degrees, more preferably greater than about 0.745 degrees and less than about 1.123 degrees, most preferably about 0.842 degrees. This amount of tapering of the internal surface 530 of the rigid shaft band 502 may generally be designed to match the tapering of the shaft 408 (shown in FIG. 4) to ensure that the rigid shaft band 502 fits well onto a tapered shaft 408 (shown in FIG. 4) as well as control the exact location of the rigid shaft band 502.

It is worth recognizing in FIG. 5 that greater than 90% of the internal surface 530 of the rigid shaft band 502 engages the shaft 408 (shown in FIG. 4) to ensure proper alignment and placement of the rigid shaft band along the shaft 408 (shown in FIG. 4). This percentage of contact between the internal surface 530 and the shaft 408 (shown in FIG. 4) may be important to the proper functionality of the rigid shaft band 502 because the angle of tapering θ, in conjunction with the proper mating of the internal surface 530 and the shaft 408 (shown in FIG. 4) determines the precise location of the rigid shaft band 402; and any mis-alignment will create an improper fit that detracts from its cosmetic appeal and performance capabilities. Inversely, if greater than 90% of the internal surface 530 engages the shaft 408 (shown in FIG. 4), the depressions 514 may comprise of less than 10% of the total internal surface 530 of the rigid shaft band 502, providing just enough area for bonding and vibration dampening without eliminating feel completely.

Figure 6:
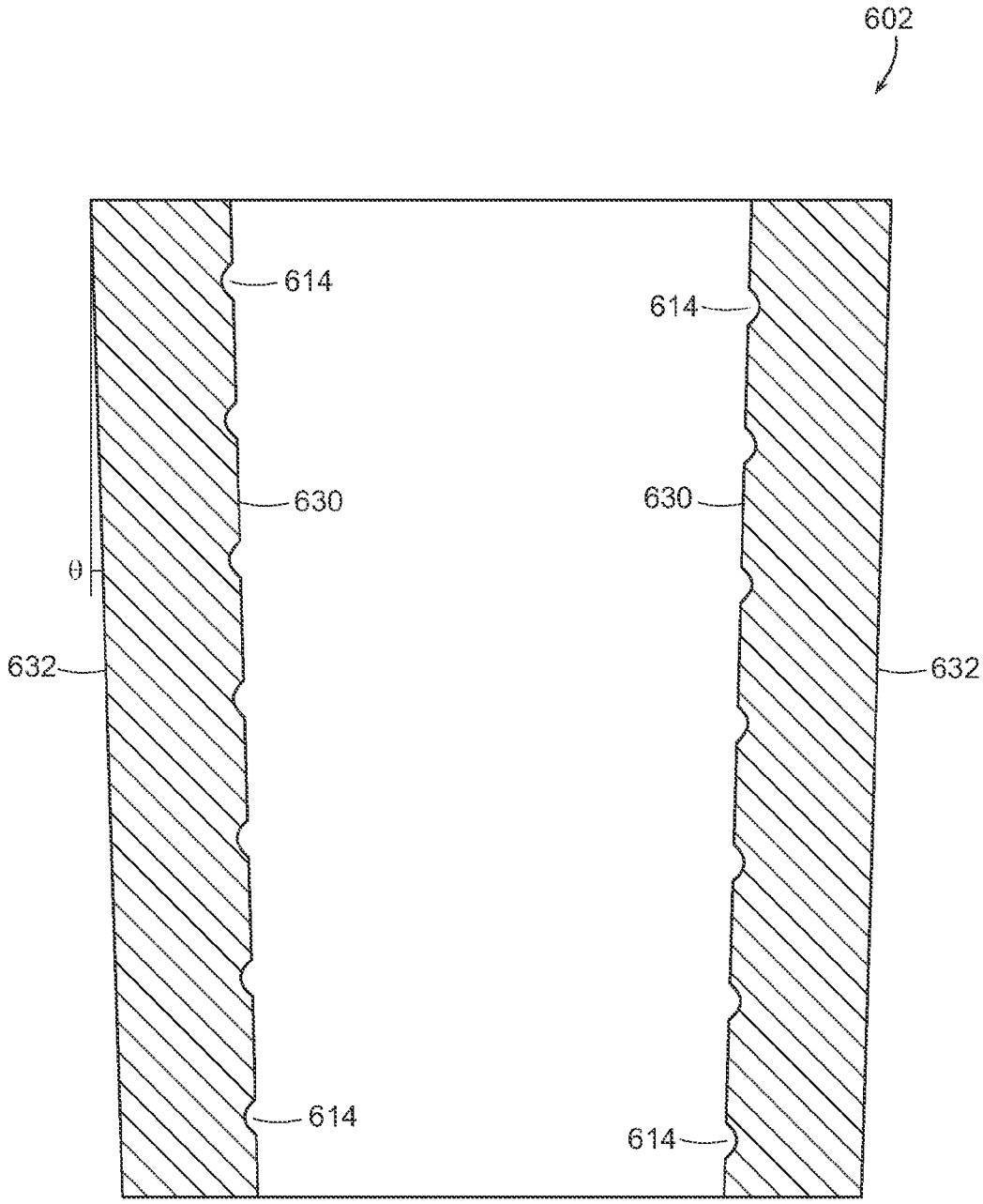
FIG. 6 shows a cross-sectional view of a rigid shaft band in accordance with an alternative embodiment of the present invention taken along cross sectional line A-A' in FIG. 2.

FIG. 6 shows an alternative embodiment of the present invention wherein the external surface 632 of the rigid shaft band 602 may be tapered by the same angle θ to create a aesthetically pleasing external surface 632 that matches with the tapering of the shaft 408 (shown in FIG. 4) without departing from the scope and content of the present invention.

Figure 7:
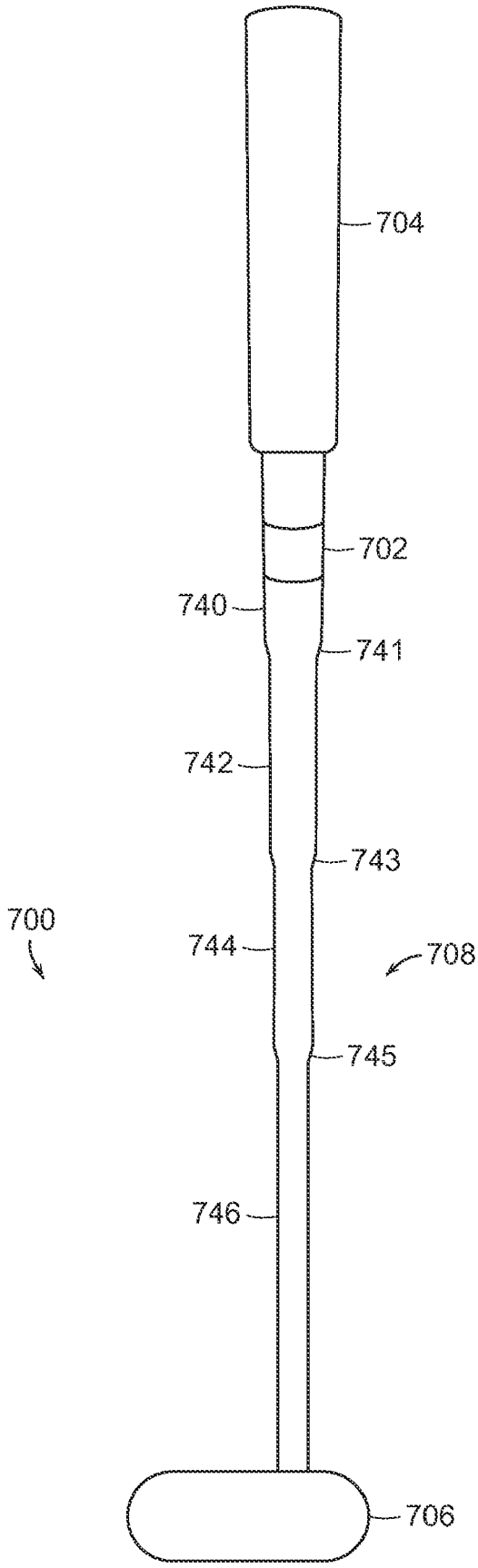
FIG. 7 shows a frontal view of a golf club in accordance with an alternative embodiment of the present invention wherein the shaft is stepped.
Figure 8:
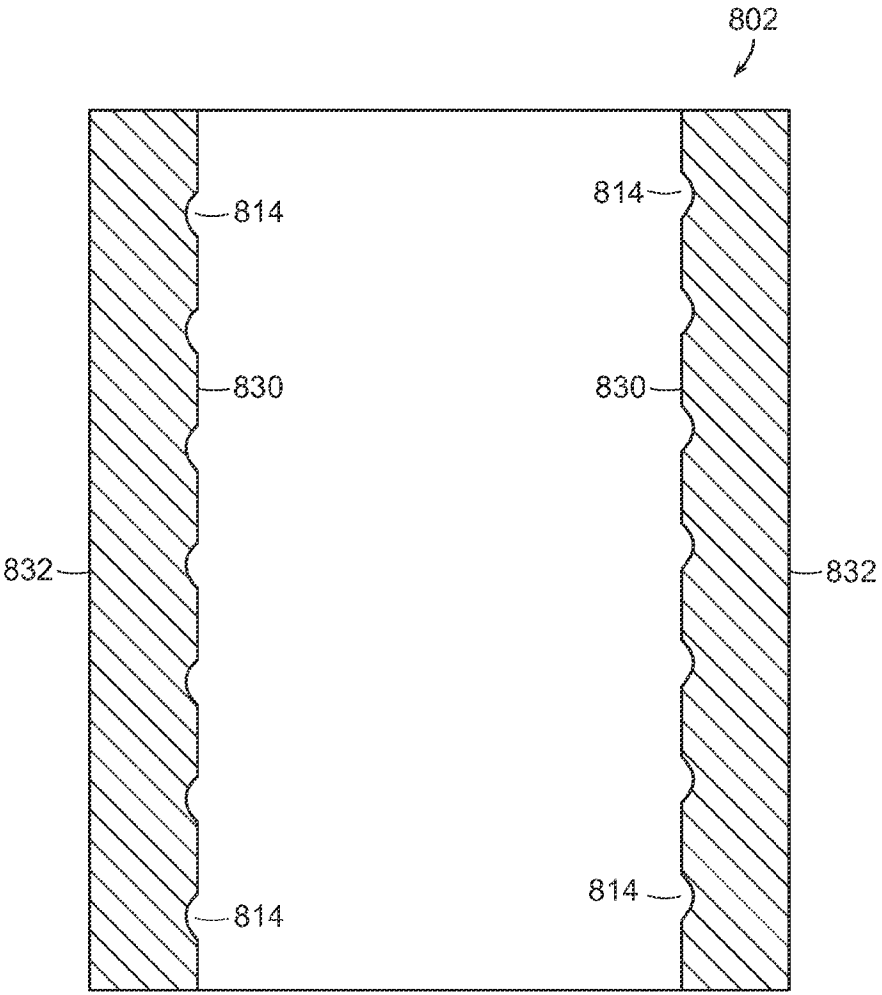
FIG. 8 shows a cross-sectional view of a rigid shaft band in accordance with an alternative embodiment of the present invention taken along cross sectional line A-A' in FIG. 2.

FIG. 7 shows a further alternative embodiment of the present invention wherein the shaft 708 is no longer tapered, but utilizes a plurality of steps 741, 743, and 745 to reduce the diameter of the shaft 708. Because the diameter of the shaft 708 is no longer tapered, the internal diameter of the rigid shaft band 702 in accordance with this alternative embodiment of the present invention will not have a taper as well. This non-tapered internal wall may be better shown in FIG. 8, wherein a cross-sectional profile of a rigid shaft band 802 shows a completely perpendicular internal surface 830. This cross-sectional profile of the rigid shaft band 802, as shown in FIG. 8, may generally reflect the cross-sectional line A-A' taken in FIG. 2.

Figure 9:
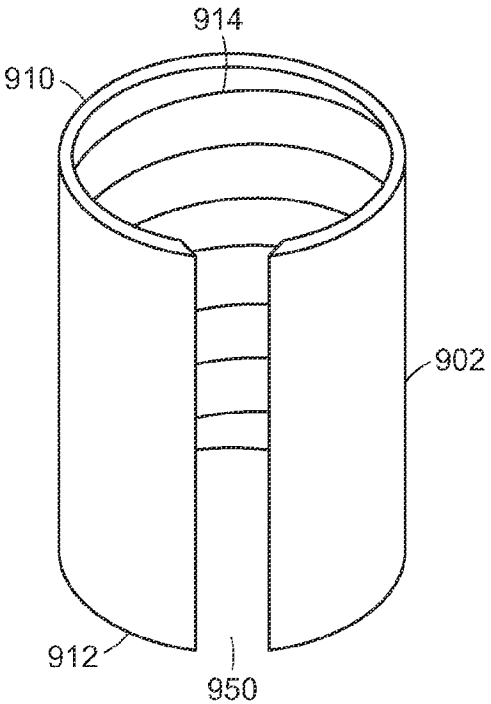
FIG. 9 shows a perspective view of a rigid shaft band in accordance with an alternative embodiment of the present invention containing an opening.

FIG. 9 shows a further alternative embodiment of the present invention wherein the rigid shaft band 902 may have an opening 950 that allows for a different aesthetically look and feel without departing from the scope and content of the present invention. More specifically, the opening 950 of the rigid shaft band 902 may allow for a way to disassemble and reassembly the rigid shaft band 902 to the shaft of the golf club by giving the rigid shaft band 950 some room to flex. More specifically, this flexibility of the rigid shaft band 902 may allow for the rigid shaft band 902 to be disassembled and reassembled without the need to remove the head of the golf club, providing an additional performance benefit in accordance with this alternative embodiment of the present invention.

Figure 10:
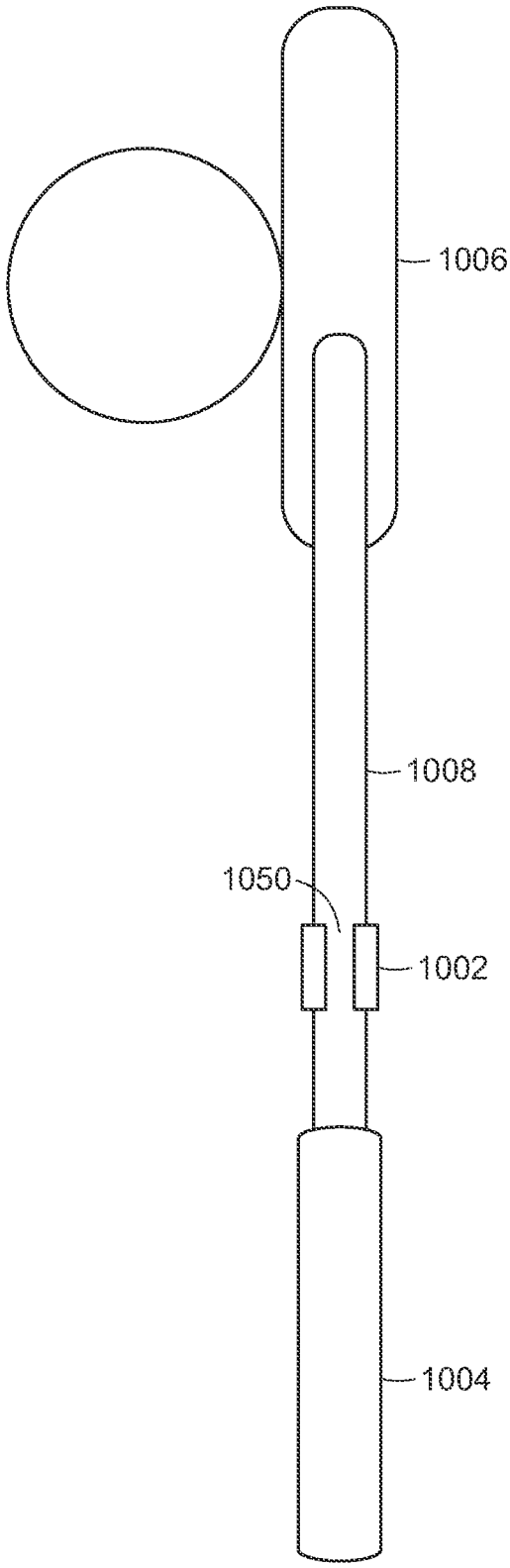
FIG. 10 shows a top view of a golf club in accordance with an alternative embodiment of the present invention from an address position.

FIG. 10 shows a top view of a golf club 1000 from an address position, utilizing a rigid shaft band 1002 with an opening 1050 to help align the golf club 1000 with a golf ball. More specifically, as it can be seen from FIG. 10, by assembling the rigid shaft band 1002 with the opening 1050 directly facing away from the golfer, an equal amount of the rigid shaft band 1002 may be seen from a golfer's line of sight on both sides of the shaft. This equal amount of visibility of the rigid shaft band 1002 on both sides of the shaft 1000 may instantaneously provide a feedback to the golfer, showing him or her whether the golf club 1000 is properly aligned. In a further alternative embodiment of the present invention, the visible portions of the rigid shaft band 1002 from the address position may have a different color than the remainder of the rigid shaft band, further enhancing the visual feedback when the golf club 1000 gets mis-aligned.

Other than in the operating example, or unless otherwise expressly specified, all of the numerical ranges, amounts, values and percentages such as those for amounts of materials, moment of inertias, center of gravity locations, loft, draft angles, various performance ratios, and others in the following portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club comprising:

a grip at a proximal end of said golf club;

a head at a distal end of said golf club;

a shaft connecting said grip and said head; and a rigid shaft band circumferentially encompassing said shaft further comprising;

an external surface;

an internal surface;

a top lip; and a bottom lip, wherein said top lip is positioned at a first distance away from said grip, wherein greater than 90% of said internal surface of said rigid shaft band engages an external shaft surface of said shaft and wherein said internal surface of said rigid shaft band comprises a depression.

2. The golf club of claim 1, wherein said first distance is greater than about 1 inch and less than about 3 inches.

3. The golf club of claim 2, wherein said first distance is about 2 inches.

4. The golf club of claim 3, wherein said depression comprises less than 10% of said internal surface of said rigid shaft band.

5. The golf club of claim 4, wherein said depression is circular in shape, rotationally traversing said internal surface of said rigid shaft band.

6. The golf club of claim 4, wherein said depression is in the shape of a continuous spiral rotationally traversing said internal surface of said rigid shaft band.

7. The golf club of claim 4, wherein said depression is filled with a bonding material.

8. The golf club of claim 4, wherein said depression is filled with a vibration dampening material.

9. The golf club of claim 4, wherein said internal surface of said rigid shaft band is tapered at a first angle that matches a second angle of a taper of said external shaft surface.

10. The golf club head of claim 9, wherein said first angle of said internal surface of said rigid shaft band is greater than about 0.573 degrees and less than about 1.146 degrees.

11. The golf club of claim 9, wherein said external surface of said rigid shaft band is tapered at a third angle that matches said first angle and said second angle.

12. A golf club comprising:

a grip at a proximal end of said golf club;

a head at a distal end of said golf club;

a shaft connecting said grip and said head; and a rigid shaft band circumferentially encompassing said shaft further comprising;

an external surface;

an internal surface;

a top lip; and a bottom lip, wherein said rigid shaft band is located substantially near a fulcrum of said golf club, wherein greater than 90% of said internal surface of said rigid shaft band engages an external shaft surface of said shaft and wherein said internal surface of said rigid shaft band comprises a depression.

13. The golf club of claim 12, wherein said rigid shaft band is located less than 1 inch away from said fulcrum of said golf club.

14. The golf club of claim 13, wherein said depression comprises of less than 10% of said internal surface of said rigid shaft band.

15. The golf club of claim 14, wherein said depression is filled with a bonding material.

16. The golf club of claim 15, wherein said internal surface of said rigid shaft band is tapered at a first angle that matches a second angle of a taper of said external shaft surface.

* * * * *